US009945054B2

(12) United States Patent
Dromain et al.

(10) Patent No.: US 9,945,054 B2
(45) Date of Patent: Apr. 17, 2018

(54) HIGH TEMPERATURE RESISTANT WEFT KNIT TEXTILE SLEEVE AND METHOD OF CONSTRUCTION THEREOF

(75) Inventors: Lionel Dromain, Crépy en Valois (FR); Jean-René Chesnais, Crépy en Valois (FR); Benoit Laurent, Trosly Breuil (FR)

(73) Assignee: Federal-Mogul Powertrain, LLC, Southfield, MI (US)

( * ) Notice: Subject to any disclaimer, the term of this patent is extended or adjusted under 35 U.S.C. 154(b) by 118 days.

(21) Appl. No.: 13/531,768

(22) Filed: Jun. 25, 2012

(65) Prior Publication Data

US 2012/0328809 A1 Dec. 27, 2012

Related U.S. Application Data

(60) Provisional application No. 61/500,724, filed on Jun. 24, 2011.

(51) Int. Cl.

| | |
|---|---|
| ***D04B 9/44*** | (2006.01) |
| ***B32B 1/08*** | (2006.01) |
| ***D04B 15/00*** | (2006.01) |
| ***D04B 1/22*** | (2006.01) |

(52) U.S. Cl.
CPC ..... *D04B 1/225* (2013.01); *D10B 2505/12* (2013.01); *Y10T 428/1362* (2015.01)

(58) Field of Classification Search
CPC ..... D04B 1/225; Y10T 428/1362
USPC ... 428/36.1, 34.1, 221, 34.5, 35.7, 364, 365, 428/36.3, 36.8, 97, 141, 196, 219, 220, 428/315.9, 339, 34.9, 35.2, 35.5, 35.6, 428/36.5, 36.9, 370, 373, 375, 402, 413, 428/521, 523, 532, 66.7, 91; 135/36.1; 66/202, 8, 215
See application file for complete search history.

(56) References Cited

U.S. PATENT DOCUMENTS 2,306,781 A * 12/1942 Francis, Jr. ..... 428/198
2,338,386 A * 1/1944 Strake ..... 26/19
4,270,368 A 6/1981 Ragoza et al.
(Continued)

FOREIGN PATENT DOCUMENTS

WO WO2007/076530 7/2007
WO WO 2008083072 A1 * 7/2008 ..... D04B 21/16

OTHER PUBLICATIONS

Rouette, Hans-Karl (2001) p. 108. Encyclopedia of Textile Finishing. Woodhead Publishing. Online version available at: http://app.knovel.com/hotlink/toc/id:kpETF00001/encyclopedia-textile.*
(Continued)

*Primary Examiner* — James C Yager
*Assistant Examiner* — Kevin C Ortman, Jr.
(74) *Attorney, Agent, or Firm* — Robert L. Stearns; Dickinson Wright, PLLC

(57) ABSTRACT

A high temperature resistant textile sleeve and method of construction thereof is provided. The textile sleeve has a flexible, tubular knit wall of thermoplastic yarns. The yarns are tightly knit with weft knit stitches extending along a circumferential direction about the tubular knit wall to provide a substantially smooth inner surface and a substantially smooth outer surface. The yarns are knit in a tricot stitch pattern, wherein the tricot knit stitches extend along a circumferentially direction of the sleeve wall.

2 Claims, 1 Drawing Sheet

(56) References Cited

U.S. PATENT DOCUMENTS

| | | | | |
|---|---|---|---|---|
| 4,282,905 | A * | 8/1981 | Dopkin | B29C 70/462 138/125 |
| 4,815,299 | A | 3/1989 | Bryant | |
| 4,856,299 | A | 8/1989 | Bryant | |
| 5,308,689 | A * | 5/1994 | Shinkai | A41D 31/02 428/315.5 |
| 6,199,594 | B1 | 3/2001 | Mezzalira | |
| 6,854,298 | B2 | 2/2005 | Relats et al. | |
| 7,216,678 | B2 | 5/2007 | Baer | |
| 7,395,680 | B2 | 7/2008 | Baer et al. | |
| 2002/0041958 | A1* | 4/2002 | Andrews | 428/373 |
| 2007/0275199 | A1* | 11/2007 | Chen | D02G 3/441 428/36.1 |
| 2008/0135119 | A1 | 6/2008 | Tonooka et al. | |
| 2009/0019624 | A1* | 1/2009 | Birk | D02G 3/443 2/455 |
| 2011/0209791 | A1 | 9/2011 | Mezzalira | |
| 2011/0313085 | A1* | 12/2011 | Chen | C08J 3/203 524/101 |
| 2012/0042980 | A1 | 2/2012 | Mezzalira et al. | |
| 2012/0148772 | A1* | 6/2012 | Avula | B32B 1/08 428/36.1 |

OTHER PUBLICATIONS

DICT (Webster's Revised Unabridged Dictionary, 1913, C. & G. Merriam Co., Springfield, Mass. Under the direction of Noah Porter, D.D., LL.D., "Knit", accessed Mar. 22, 2017, p. 1-2).*

* cited by examiner

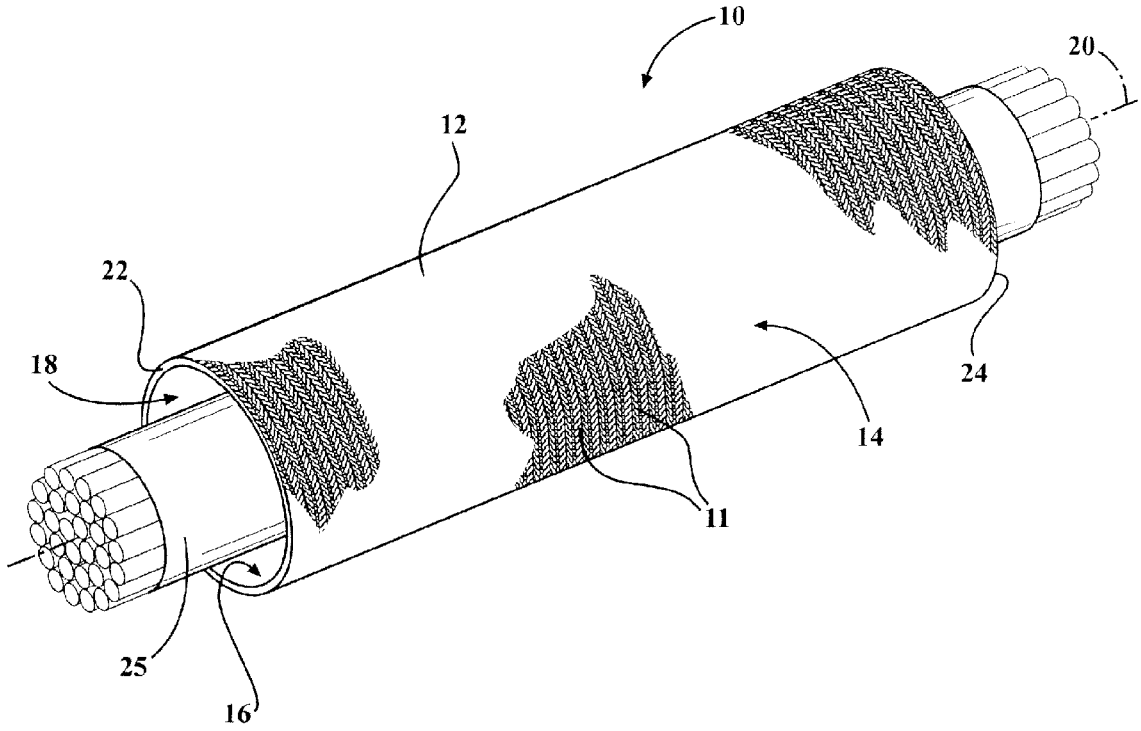
10
20
12
22
18
24
14
11
25
16

HIGH TEMPERATURE RESISTANT WEFT KNIT TEXTILE SLEEVE AND METHOD OF CONSTRUCTION THEREOF

CROSS-REFERENCE TO RELATED APPLICATION

This application claims the benefit of U.S. Provisional Application Ser. No. 61/500,724, filed Jun. 24, 2011, which is incorporated herein by reference in its entirety.

BACKGROUND OF THE INVENTION

1. Technical Field

This invention relates generally to textile sleeves for protecting elongate members, and more particularly to knit textile sleeves having a high resistance to radiant heat.

2. Related Art

Tubular sleeves are known to provide protection to elongate members contained therein, such as a wire harness, fluid or gas conveying tubes, or cable, for example. Some protective sleeve applications must provide protection to the elongate members against exposure to high temperature radiant heat. One such type of sleeve is constructed of tubular ethylene propylene diene monomer rubber (EPDM). Sleeves constructed of EPDM provide basic mechanical protection and typically have smooth inner and outer surfaces to prevent abrasion of the elongate members being protected and to prevent abrasion of external components, and further, they remain generally tubular and are flexible. However, being constructed of EPDM, these sleeves are limited to withstanding a temperature of radiant heat up to about 250 degrees F., or less.

SUMMARY OF THE INVENTION

A high temperature resistant textile sleeve has a flexible, tubular knit wall of thermoplastic yarns. The yarns are tightly knit with weft knit stitches extending along a circumferential direction about the tubular knit wall to provide a substantially smooth inner surface and a substantially smooth outer surface.

In accordance with another aspect of the invention, the yarns are knit in a tricot stitch.

In accordance with another aspect of the invention, the wall is circumferentially continuous along the full length of the sleeve.

In accordance with another aspect of the invention, the yarns are selected from the group consisting of polyesters and polyamides.

In accordance with another aspect of the invention, a method of constructing a high temperature resistant protective textile sleeve is provided. The method includes providing thermoplastic yarn filaments, and knitting a tubular wall on a circular weft knitting machine from the thermoplastic filaments.

In accordance with another aspect of the invention, the method includes knitting the thermoplastic yarn filaments with tricot stitches.

In accordance with another aspect of the invention, the method includes selecting the thermoplastic filaments from the group consisting of polyesters and polyamides.

BRIEF DESCRIPTION OF THE DRAWINGS

These and other aspects, features and advantages of the invention will become readily apparent to those skilled in the art in view of the following detailed description of the presently preferred embodiments and best mode, appended claims, and accompanying drawings, in which:

FIG. 1 is a schematic perspective view of a high temperature knit protective textile sleeve constructed in accordance with one aspect of the invention.

DETAILED DESCRIPTION OF PREFERRED EMBODIMENTS

Referring in more detail to the drawings, FIG. 1 shows a tubular textile sleeve 10 constructed according to one embodiment of the invention. The textile sleeve 10 includes a plurality of yarns 11 interlaced with one another via a knitting machine, and more specifically, on a circular weft knitting machine, to form a wall 12. The wall 12 is knitted in seamless fashion, and thus, is circumferentially continuous (free of open seams) having an outer surface 14 and an inner surface 16 defining an internal cavity 18 extending axially along a central longitudinal axis 20 between open opposite ends 22, 24 of the sleeve 10. The cavity 18 is sized for receipt of an elongate member 25 to be protected, such as a wire harness, fluid or gas conveying conduit, cable or the like. The yarns are formed from thermoplastic material capable of withstanding high temperatures, such as about 300 degrees Fahrenheit, or higher, for an extended period of time. The yarns 11 are tightly knit to provide the outer and inner surfaces 14, 16 with a smooth or substantially smooth surface texture, thereby avoiding unwanted abrasion or friction against the elongate member 25 and any external components adjacent the outer surface 14.

The wall 14 can be constructed having any suitable length and diameter and is knit having a tight knit structure to enhance the protection provided by the wall 12 to the elongate member 25 and also inhibiting damage to the sleeve 10, which could otherwise be caused by friction or tearing if the wall were not tightly knit. In accordance with one aspect of the invention, the knit pattern is formed entirely of tricot knit stitches which provide the wall 14 with the desired tight and smooth knit structure and texture. The tricot knit stitches, being weft knit, extend along a circumferential direction of the wall 12 and about the longitudinal axis 20. The wall 14 is knit including thermoplastic yarn filaments capable of withstanding high temperatures, such as polyesters or polyamides, and thus, provides enhanced protection to the elongate members 25 against high external temperatures ranging up to or slightly beyond 300 degrees Fahrenheit.

In accordance with another aspect of the invention, a method of constructing a textile sleeve 10 is provided. The method includes providing thermoplastic yarn filaments 11 and knitting a tubular wall 12 from the thermoplastic filaments 11 via a circular weft knitting machine. The knitting process is performed via interlinking tricot knit stitches to form the wall 12 having a tightly knit, circumferentially continuous, seamless structure along the full length of the sleeve 10. The yarn used to knit the wall 12 is provided having a high temperature performance rating, and is selected from the group consisting of polyesters and polyamides.

It is to be understood that the above detailed description is with regard to some presently preferred embodiments, and that other embodiments readily discernible from the disclosure herein by those having ordinary skill in the art are incorporated herein and considered to be within the scope of any ultimately allowed claims.

What is claimed is:

1. A wire, cable, and conduit protective sleeve, consisting of:

a flexible, tubular wall of thermoplastic yarns, said yarns being knit solely with weft knit tricot stitches, said weft knit tricot stitches extending along a circumferential direction of the tubular wall; and wherein said yarns are selected from the group consisting of polyesters and polyamides.

2. The protective sleeve of claim 1 wherein said wall is circumferentially continuous and seamless.

* * * * *